US011584501B2

(12) United States Patent
Bondesson et al.

(10) Patent No.: US 11,584,501 B2
(45) Date of Patent: Feb. 21, 2023

(54) JOYSTICK DEVICE FOR A MARINE VESSEL

(71) Applicant: VOLVO PENTA CORPORATION, Gothenburg (SE)

(72) Inventors: Anders Bondesson, Gothenburg (SE); Katarina Hammar, Vallda (SE); Anders Thorin, Hindås (SE); Therese Dekker, Olofstorp (SE); Simon Larsson, Styrsö (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 68 days.

(21) Appl. No.: 17/257,801

(22) PCT Filed: Jul. 5, 2018

(86) PCT No.: PCT/EP2018/068240

§ 371 (c)(1),
(2) Date: Jan. 4, 2021

(87) PCT Pub. No.: WO2020/007471

PCT Pub. Date: Jan. 9, 2020

(65) Prior Publication Data

US 2021/0163114 A1 Jun. 3, 2021

(51) Int. Cl.

| | |
|---|---|
| ***B63H 25/02*** | (2006.01) |
| ***G05G 9/04*** | (2006.01) |
| ***G05G 9/047*** | (2006.01) |

(52) U.S. Cl.

CPC ..... *B63H 25/02* (2013.01); *G05G 9/04788* (2013.01); *B63H 2025/026* (2013.01)

(58) Field of Classification Search

CPC ..... B63H 25/00; B63H 25/02; B63H 25/42; B63H 21/21; B63H 2025/026;

(Continued)

(56) References Cited

U.S. PATENT DOCUMENTS

| | | | |
|---|---|---|---|
| 4,584,510 | A | 4/1986 | Hollow |
| 7,112,107 | B1 | 9/2006 | Torgerud |

(Continued)

FOREIGN PATENT DOCUMENTS

| | | | |
|---|---|---|---|
| EP | 2706007 | A1 | 3/2014 |
| EP | 2878858 | A1 | 6/2015 |

(Continued)

OTHER PUBLICATIONS

European Office Action dated Feb. 28, 2022 in corresponding European Patent Application No. 18739825.0, 5 pages.

(Continued)

*Primary Examiner* — Lars A Olson

(74) *Attorney, Agent, or Firm* — Venable LLP; Jeffri A. Kaminski

(57) ABSTRACT

The present disclosure generally relates to a joystick device (100) operable to provide speed, direction and steering commands for controlling a marine vessel (300), the joystick device (100) comprising a movable steering lever (102) extending on an axis (V) and adapted to be tilted from a neutral position in at least four directions including a forward, a rearward, a leftward, and a rightward direction, wherein—an active length of the movable steering lever (102) is adjustable between a first (L1) and a second (L2) lever length,—the first lever length (L1) is shorter than the second lever length (L2),—a first mode for operating the marine vessel (300) is associated with the first lever length (L1), and—a second mode for operating the marine vessel (300) is associated with the second lever length (L2), the second mode being different from the first mode for operating the marine vessel (300).

14 Claims, 4 Drawing Sheets

(58) Field of Classification Search
CPC ..... G05G 9/04788; G05G 1/00; G05G 1/01; G05G 1/015; G05G 1/02; G05G 1/04; G05G 1/06
USPC ..... 114/144 R
See application file for complete search history.

(56) References Cited

U.S. PATENT DOCUMENTS

| | | | | |
|---|---|---|---|---|
| 9,039,468 | B1 | 5/2015 | Arbuckle et al. | |
| 9,387,916 | B2 * | 7/2016 | Skauen | B63H 25/42 |
| 10,520,973 | B2 * | 12/2019 | Parazynski | G05G 1/01 |
| 2003/0188594 | A1 | 10/2003 | Levin et al. | |
| 2006/0137931 | A1 | 6/2006 | Berg et al. | |
| 2010/0302017 | A1 | 12/2010 | Guglielmo | |
| 2015/0246716 | A1 | 9/2015 | Skauen | |

FOREIGN PATENT DOCUMENTS

| | | | |
|---|---|---|---|
| EP | 3006327 | A1 | 4/2016 |
| EP | 3048038 | A1 | 7/2016 |
| FR | 2995718 | A1 | 3/2014 |
| GB | 2178143 | A | 2/1987 |
| JP | 2017052297 | A | 3/2017 |

OTHER PUBLICATIONS

International Search Report and Written Opinion dated Mar. 11, 2019 in corresponding International PCT Application No. PCT/EP2018/068240, 11 pages.
International Preliminary Report on Patentability dated Jun. 12, 2020, in corresponding International PCT Application No. PCT/EP2018/068240, 14 pages.
Kelley et al., United States Statutory Invention Registration No. USH183H, published Feb. 1, 2020, 15 pages.

* cited by examiner

JOYSTICK DEVICE FOR A MARINE VESSEL

CROSS-REFERENCE TO RELATED APPLICATIONS

This application is a U.S. National Stage application of PCT/EP2018/068240, filed Jul. 5, 2018, and published on Jan. 9, 2020, as WO 2020/007471 A1, all of which is hereby incorporated by reference in its entirety.

TECHNICAL FIELD

The present disclosure generally relates to a joystick device operable to provide speed, direction and steering commands for controlling a marine vessel. The present disclosure also relates to a marine propulsion control system controlling a set of propulsion units carried by a hull of a marine vessel, wherein the marine propulsion control system is adapted to receive an input command from such a joystick device.

BACKGROUND

Today's marine vessels are often equipped with a plurality of propulsion units for driving the vessel. In a typical implementation, the marine vessel comprises a steering wheel for controlling a direction of the marine vessel and at least one thrust regulator for controlling a speed and direction of the propulsion units. In addition, it has been proposed, e.g. in U.S. Pat. No. 9,266,594, to additionally use a joystick device for allowing docking of the marine vessel.

To further simplify marine vessel operation, it has been proposed to combine the functionality of the steering wheel, the thrust regulator and the joystick into a single "boat maneuvering joystick", as is exemplified in U.S. Pat. No. 9,387,916. The boat maneuvering joystick disclosed in U.S. Pat. No. 9,387,916 comprises a base with sensors arranged for detecting a position of the maneuvering joystick. The maneuvering joystick comprises a first bidirectional control knob and a second bidirectional control knob, arranged movably relative each other. The maneuvering joystick also comprises first control sensors detecting a first position of the first bidirectional control knob and second control sensors detecting a second position of the stern control knob.

Accordingly, by means of U.S. Pat. No. 9,387,916 it is possible for a helmsperson to solely concentrate on a single device for operating the marine vessel. However, the solution presented in U.S. Pat. No. 9,387,916 is cluttered with buttons and knobs for achieving the desired "combinatory effect" (i.e. combination of steering wheel, thrust regulator and docking joystick), whereby operation of the marine vessel by the e.g. an inexperienced helmsperson will be overly complicated.

Accordingly, there appears to be room for further improvements in regards to joysticks adapted for providing the mentioned combinatory effect, specifically focused on achieving an overall simplified interface for operating a marine vessel.

SUMMARY

In accordance to another aspect of the present disclosure, the above is at least partly alleviated by means of a joystick device operable to provide speed, direction and steering commands for controlling a marine vessel, the joystick device comprising a movable steering lever extending on an axis and adapted to be tilted from a neutral position in at least four directions including a forward, a rearward, a leftward, and a rightward direction, wherein an active length of the movable steering lever is adjustable between a first and a second lever length, the first lever length is shorter than the second lever length, a first mode for operating the marine vessel is associated with the first lever length, and a second mode for operating the marine vessel is associated with the second lever length, the second mode being different from the first mode for operating the marine vessel.

In accordance to the present disclosure, the idea is to allow for a simplified operation of a marine vessel, whereby a helmsperson is allowed to put full focus on using a single device for controlling the marine vessel during different operational modes thereof.

It should be understood that in line with the present disclosure an overall length of the movable steering lever is typically not adjusted. Rather, the "distance" (length) from a top end of the movable steering lever to an appeared pivot point is adjusted, wherein this distance is defined using the expression "active length of the movable steering lever". Thus, using the same movable steering lever and without adjusting its overall length, the distance to the pivot point is adjusted based on the operational mode, i.e. a short length in the first mode and a longer length when in the second mode. As would be apparent based on the above, the user experience will be completely different dependent on if the joystick device is in the first or the second mode.

Thus, the operation of the joystick is in line with the present disclosure inherently adapted based on a current situation for handling the marine vessel. Specifically, by means of adapting the lever length for the joystick device the helmsperson will handle the joystick device differently, wherein a shorter lever length typically will appear as suitable when "detailed control" ("micro control mode") of the marine vessel, such as when for example performing docking operation (e.g. corresponding to the first mode). Conversely, when the active lever length is in comparison longer, the joystick device will appear more suitable to "general control" ("macro control mode") of the marine vessel, such as for example in relation to a "high-speed" operation of the marine vessel (e.g. the corresponding to the second mode).

It may in some embodiments of the present disclosure be possible to allow the movable steering member to be rotatable around the axis for providing rotational commands for controlling the marine vessel. That is, the joystick device may in such an embodiment advantageously be used for "twisting" the marine vessel (yaw). Specifically, by rotating/twisting the movable steering member, the marine vessel is controlled to rotate/twist. The twisting/rotating action may preferable be allowed to be performed both in a clockwise and an anti-clockwise manner, thus rotating/twisting the vessel in a corresponding manner.

It is further preferred to implement the twisting/rotating of the movable steering member such that the movable steering member automatically may return back to a rotational neutral position thereof, e.g. once the helmsperson lets go of the movable steering member. Such an implementation may for example comprise one of a plurality of springs for achieving the return function.

Generally speaking in relation to the neutral position for tilting of the movable steering lever, it should however be understood that this neutral position not necessarily may result in the trust provided by the propulsion units is set to zero. Rather, in some embodiments it may be possible that the neutral positions relate to a predetermined "geographical position", such as a GPS position, where e.g. the helmsperson has a desire that the vessel should stay (such as during a fishing expedition). As such, the neutral position may still result in that some thrust is provided by some of the propulsion units to counter e.g. currents and wind such that the vessel "stands still".

In line with the above discussion, in accordance to the present disclosure, the movable steering member may in one embodiment be adapted to be tilted from the neutral position in an arbitrary direction including the forward, the rearward, the leftward, and the rightward direction. As such, independent on if the joystick device is in the first or the second mode; the joystick may be used for controlling direction of the vessel not being just a forward or backward direction.

Dependent on the desired implementation of the joystick device, it may in some embodiments be desirable to only allow the transition between the first and the second mode to take place when the movable steering member is arranged in the neutral position. That is, such an implementation may effectively allow for undesirable maneuvers to take place in case e.g. the helmsperson unintentionally switch between the first and the second mode. Using the proposed transitional limitation, it may be possible to ensure that the speed of travel for the marine vessel is reduced when transitioning between the separate modes.

In an embodiment of the present disclosure, the joystick device further comprises an electronic processing circuit adapted to receive an indication of a desire to transition between the first and the second mode, and control mechanical means for adjust the active length of the movable steering lever dependent on a state of the indication. In some embodiment of the present disclosure the indication of a desire to transition between the first and the second mode is received from a user interface, such as for example by means of a button or similar comprised with the joystick device or arranged in communication with the electronic processing circuit.

As an alternative, the indication of a desire to transition between the first and the second mode may be formed based on at least one of a speed and a geographical location of the marine vessel. This will be further elaborated below in the detailed description of the present disclosure.

In a further embodiment of the present disclosure, it may be possible to provide the joystick device with feedback means adapted to create a haptic effect perceivable at the movable steering member. Accordingly, depending on e.g. the direction of inclination of the movable steering member (such as at an end position in regard to inclination), the helmsperson holding e.g. a hand at the movable steering member may be given feedback, typically without the helmsperson having to look at the movable steering member for determining in what direction the movable steering member is inclined. The haptic effect may also be provided for different purposes, e.g. for indicating an upcoming obstacle in case the vessel is to continue to move in the current direction, etc., based on e.g. information received from another control system comprised with the vessel.

In accordance to the present disclosure, the movable steering lever may comprise a first and a second movable steering lever portion. In an embodiment, a first end of the first movable steering lever portion may be arranged in relation to a base at a first controllable pivot point, and a second end of the first movable steering lever portion may be connected to a first end of the second first movable steering lever portion at a second controllable pivot point. In line with this embodiment, controlling the "movability" of the first and the second pivot point (joint) effectively controls the active length of the movable steering lever. It should be understood that the present disclosure is not necessarily limited to only two controllable pivot points. Rather, additional controllable pivot points may be included, whereby e.g. the active length may be further controlled.

In an embodiment, when in the first mode the first controllable pivot point (e.g. implemented using a joint arrangement) may be controlled to be fixed, and the second controllable pivot point (e.g. also implemented using a further joint arrangement) may be controlled to be movable. Correspondingly, when in the second mode the first controllable pivot point may be controlled to be movable and the second controllable pivot point may be controlled to be fixed. It should however be understood that in a further (alternative) embodiment may be possible to control both the first and the second controllable pivot point to be movable, thereby arranging the joystick device in a third mode, wherein the third mode typically is different from the first and the second mode.

According to another aspect of the present disclosure, there is provided a marine propulsion control system controlling at least one propulsion units carried by a hull of a marine vessel, the marine propulsion control system comprising an electronic processing circuit configured to receive an input command from a joystick device according to any one of the preceding claims, and provide a set of control commands for controlling a desired delivered thrust, gear selection and steering angle for the at least one propulsion units. This aspect of the present disclosure provides similar advantages as discussed above in relation to the previous aspect of the present disclosure.

The marine propulsion control system may in turn be comprised with a marine vessel, further comprising at least one propulsion unit and a joystick device as discussed above. Any number of propulsion units may be comprised with the marine vessel. Further propulsion units may for example be included not necessarily only arranged at the stern of the marine vessel, but also at a bow, that is, a so called bow thruster.

Further advantages and advantageous features of the present disclosure are disclosed in the following description and in the dependent claims.

BRIEF DESCRIPTION OF THE DRAWINGS

With reference to the appended drawings, below follows a more detailed description of embodiments of the present disclosure cited as examples.

In the drawings.

DETAILED DESCRIPTION

Figure 1A:
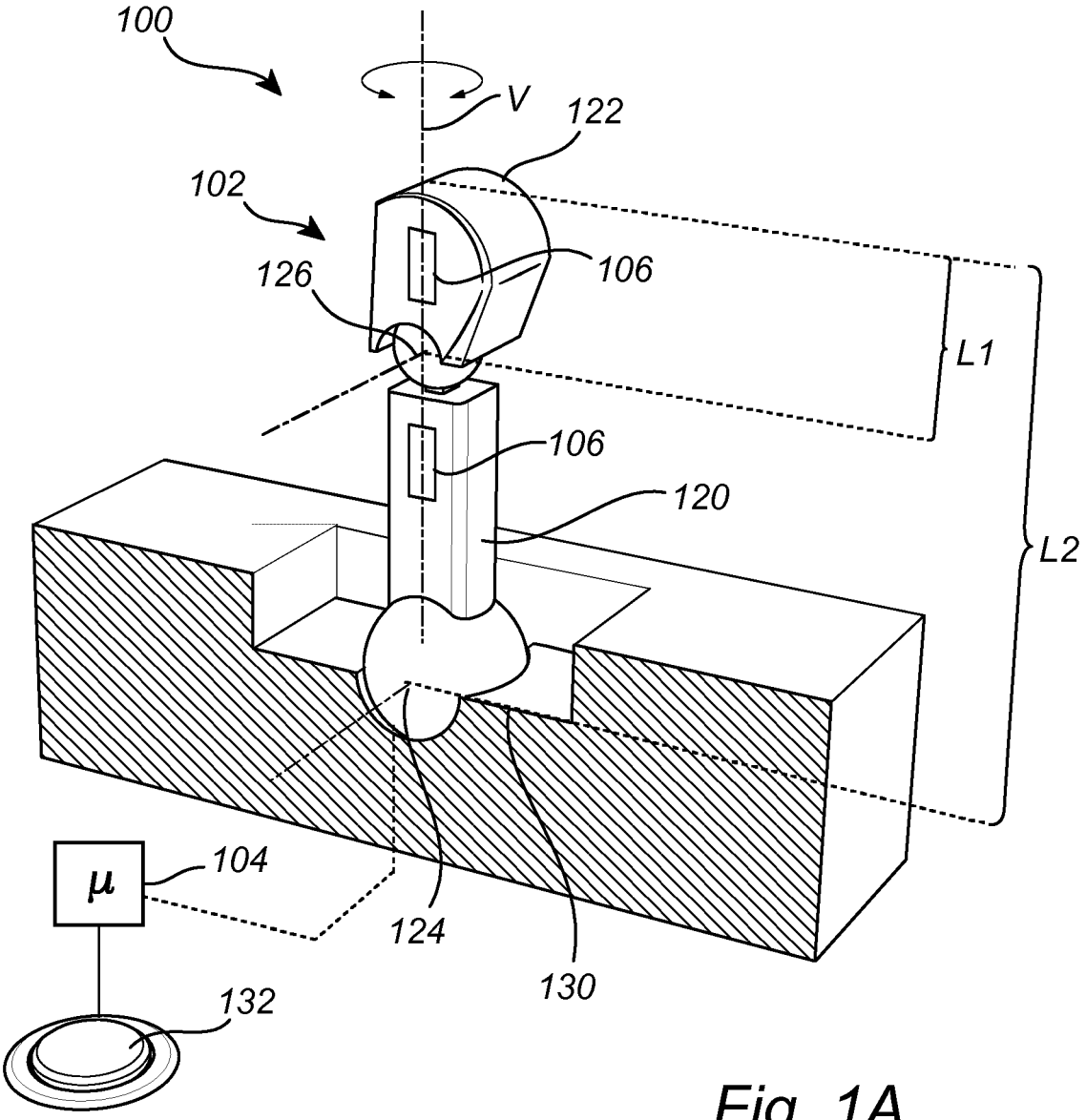
FIGS. 1A-1C conceptually illustrate embodiments of a joystick device according to the present disclosure.

The present disclosure will now be described more fully hereinafter with reference to the accompanying drawings, in which currently preferred embodiments of the present disclosure are shown. This disclosure may, however, be embodied in many different forms and should not be construed as limited to the embodiments set forth herein; rather, these embodiments are provided for thoroughness and completeness, and fully convey the scope of the disclosure to the skilled addressee. Like reference characters refer to like elements throughout.

Referring now to the drawings and to FIG. 1 in particular, there is conceptually depicted a joystick device 100 adapted for controlling a marine vessel. The joystick device 100 comprises a movable steering member 102 extending on an axis V and adapted to be tilted from a neutral position in at least four directions including a forward, a rearward, a leftward, and a rightward direction. Thus, the tilting direction of the movable steering member 102 is used for issuing commands for use in at least forward or reverse surge, left or right sway movement of the vessel. It should however be understood that the movable steering member 102 in some embodiments may be tilted/inclined in any direction, such as in between the forward and leftward direction, etc.

Moreover, the movable steering member 102 may also be rotatably operated so as to issue an operating instruction for achieving a yaw movement of the vessel. In one embodiment this is accomplished by rotating the movable steering member 102 about its vertical axis, V. When the movable steering member 102 is altered from a neutral position, a detection signal is transmitted to an electronic processing circuit 104. For example, when a helmsperson (or other operator) tilts the joystick to the port side and rotates it clockwise the propulsion units are controlled such that a hull of the vessel moves in a sway movement translational to the port side with a clockwise rotation.

Furthermore, it should be understood that the level of inclination, possibly dependent on if the joystick device 100 is arranged in the first or the second mode, may determine the level of trust to be provided for moving the vessel. That is, an increasing inclination of the movable steering member 102 corresponds to a comparable increase of the speed for movement of the vessel. The relation may possibly, but not necessarily, be linear. The joystick device 100 may for example comprise sensors (not shown) or other means for detecting a position of the movable steering member 102, such as the current inclination of the movable steering member 102.

The joystick device 100 further comprises feedback means 106 adapted to create a haptic effect perceivable at the movable steering member 102. Such feedback may for example appear when the movable steering member 102 has been pushed as far as possible to an "end tilting position". Such a feedback may also be provided e.g. "just before" a gear is engaged or changed.

Furthermore, in some embodiments of the present disclosure it may be possible to allow the joystick device 100 to comprise e.g. a "button" 132 for allowing the helmsperson to indicate if the joystick device 100 is to be in the first or the second mode.

However, it may in accordance to the present disclosure be possible to allow the transition from the first to the second mode to take place based on other "non-helmsperson" initiated input. That is, the transition between the first and the second mode may for example take place in case it is determined, e.g. by the electronic processing circuit 104 and a GPS receiver comprised with the vessel (not shown), that the vessel travels above a predetermined speed. For example, in case the electronic processing circuit 104 determines that the vessel travels above e.g. five knots (should be understood as a non-limiting example), the joystick device 100 may automatically transition from the first to the second mode. The transition may also (or alternatively) be location based (docking zone, map based) or time based.

Furthermore, in the illustrated embodiment the movable steering member 102 in turn comprises a first 120 and a second 122 movable steering lever portion. A first end of the first movable steering lever portion 120 is arranged in relation to e.g. a base 130 at a first controllable pivot point 124, and a second end of the first movable steering lever portion 120 is connected to a first end of the second movable steering lever portion 122 at a second controllable pivot point 126.

Figure 1B:
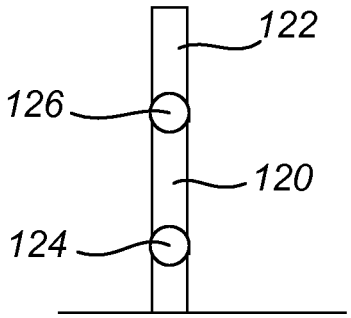
Figure 1C:
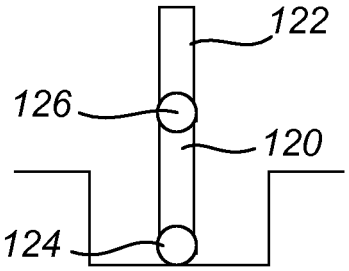

With further reference to FIGS. 1B and 1C, it should be understood that the arrangement of the first controllable pivot point 124 in relation to the base 130 should be interpreted broadly. That is, the first controllable pivot point 124 may in one embodiment be arranged in an elevated manner (FIG. 1B) or in below a main surface of the base 130 (FIG. 1C). Independently of the implementation, the concept in line with the present disclosure is the same.

Figure 2A:
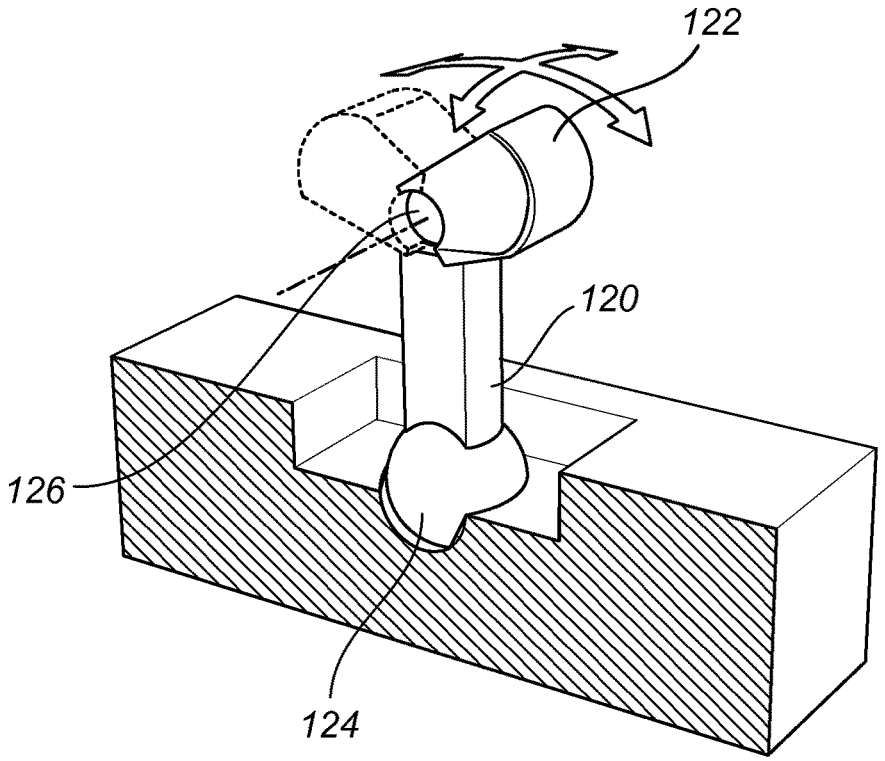
FIGS. 2A-2C provides illustrative examples of the operation of the joystick device, and FIG. 3 exemplifies a marine vessel comprising a marine propulsion control system for operating the marine vessel using the joystick device of FIG. 1.
Figure 2B:
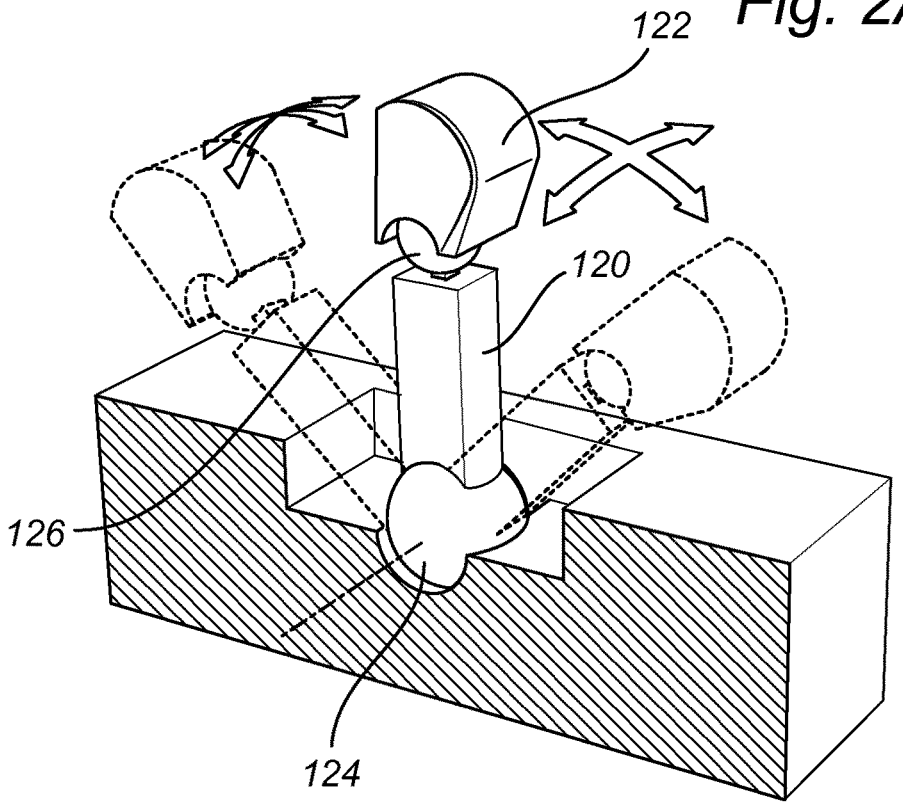
Figure 2C:
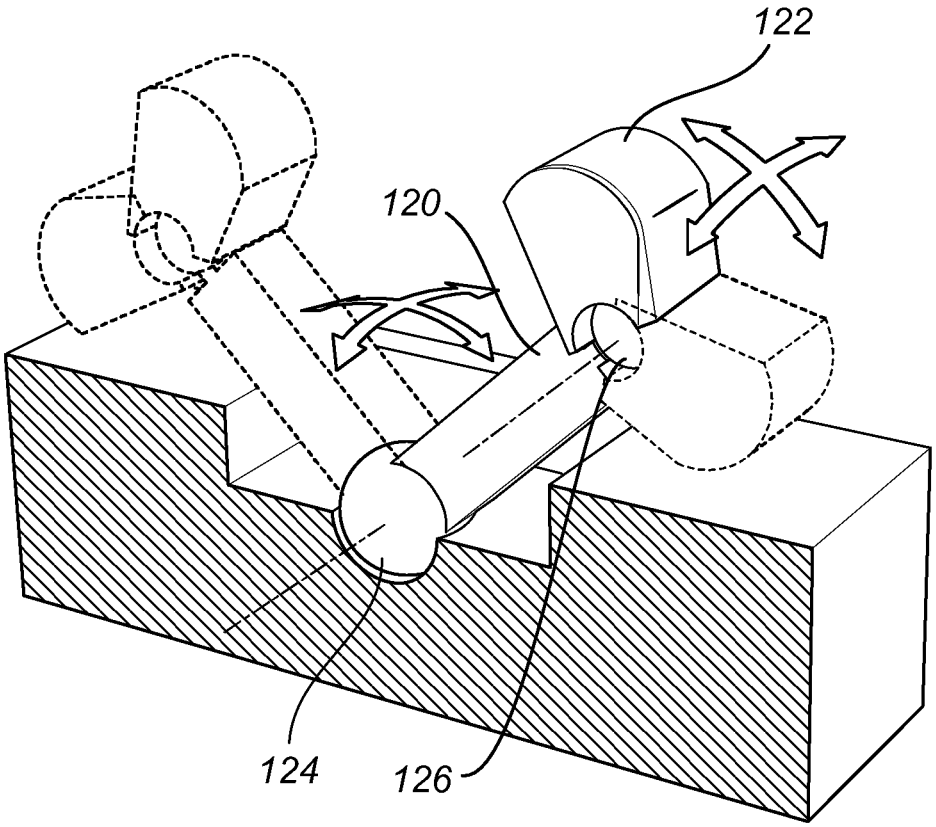

During operation of the joystick device 100, with further reference to FIGS. 2A-2C, the joystick device 100 may be controlled in a first or a second mode. As previously discussed, the first mode may for example correspond to a docking mode, where the vessel is intended to be operated at a low speed for high controllability, where a low speed mode e.g. is when the vessel is operated below five knots. Conversely, when the joystick device 100 is arranged in the second mode, the vessel may for example be adapted to be "normally operated", such as at a higher speed as compared to when the joystick device 100 is arranged in the first mode.

In line with the above, the "controllability" of the first 124 and the second 126 pivot point may allow for the pivot points 124, 126 to be arranged in a fixed or in a movable manner. For example, the joint provided for implementing the pivot points 124, 126 may be adapted for allowing an increase or decrease of an inertia at the related joint. It should further be understood that a "default" inertia of the joint implementing the first pivot point 124 may be set differently as compared to an inertia of joint implementing the second pivot pint 126.

For example, in case the joystick device 100 is arranged in the docking mode, the first controllable pivot point 124 may be set to be fixed and the second controllable pivot point 126 may be movable, as illustrated in FIG. 2A. The user experience for the helmsperson will thus be that the helmsperson in controlling a movable lever with an in comparison short length (L1 as illustrated in FIG. 1A). At the same time, the joint implementing the second pivot point 126 may be set to be in comparison low inertia. Accordingly, not only is the helmsperson controlling a "short" lever 102, but the feel of the lever 102 is that the lever 102 is "easily" maneuvered.

Conversely, when the joystick device 100 is arranged in the second mode, such as a high-speed mode, then the first controllable pivot point 124 may be set to be movable and the second controllable pivot point 126 may be fixed, as illustrated in FIG. 2B. Accordingly, the user experience for the helmsperson will thus be that the helmsperson in controlling a movable lever with an in comparison long length (L2 as illustrated in FIG. 1A). At the same time, the joint implementing the first pivot point 124 may be set to be in comparison high inertia. Accordingly, not only is the helmsperson controlling a "long" lever 102, but the feel that he needs to provide a bit of power for maneuvering the lever 102. Thus, using the same movable steering lever 102 of the joystick device 100, two completely different user experiences may be provided to the helmsperson, where the two different modes of operations are selected to correspond to a way of maneuvering the vessel.

In a further embodiment as illustrated in FIG. 2C, both the first 124 and the second 126 controllable pivots point are arranged in the movable state. Accordingly, such an embodiment may for example be used for implementing a third mode of operating the vessel, where the third mode may be selected differently as compared to the first and the second mode. As an alternative, the third mode may be an alternative high-speed mode (corresponding to the second mode), where the first movable steering lever portion 120 is used for controlling e.g. a speed of the marine vessel and the second movable steering lever portion 122 is used for controlling the direction of the marine vessel.

Figure 3:
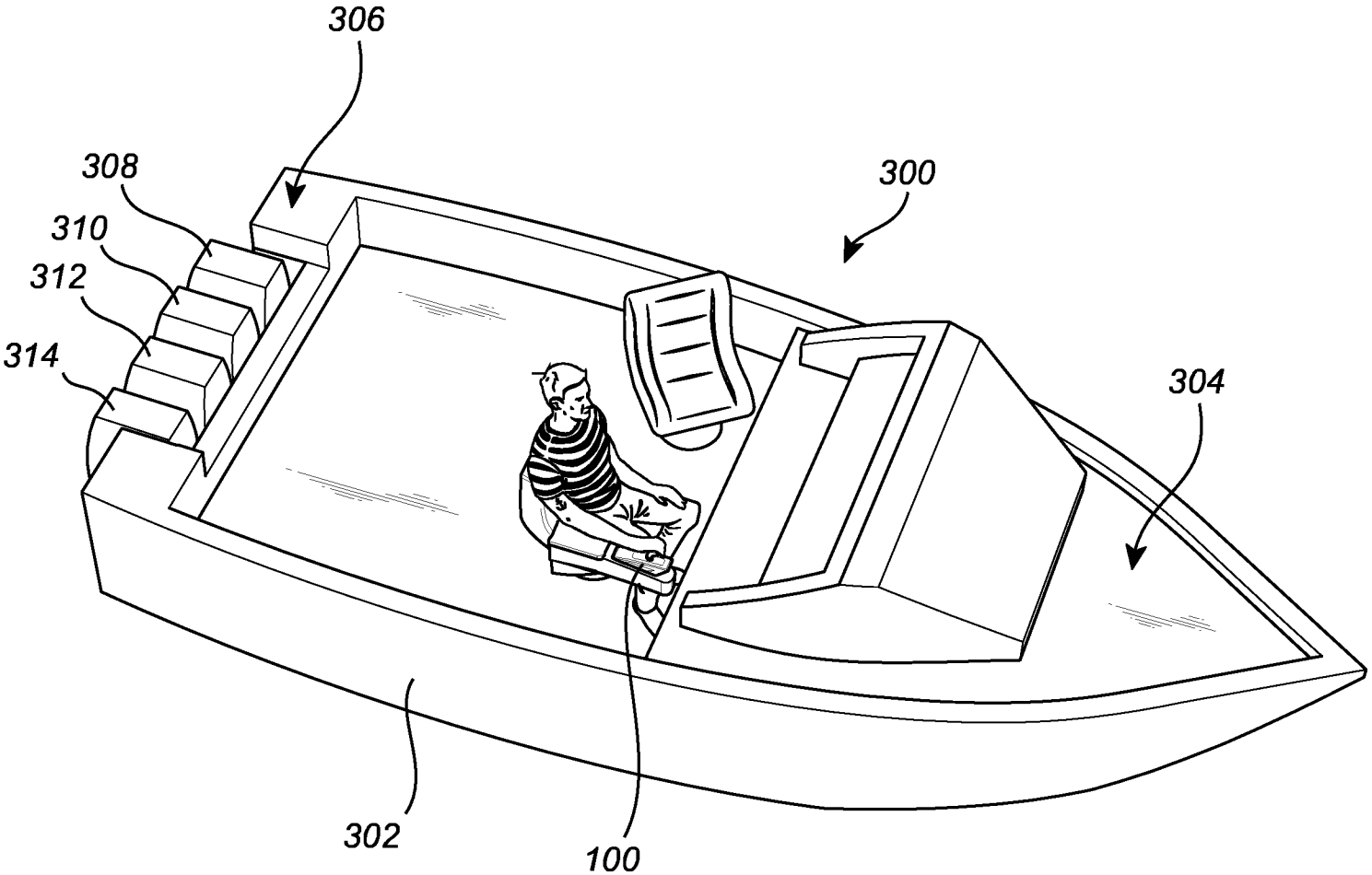

Turning finally to FIG. 3, there shown an example of a marine vessel 300 comprising a marine propulsion control system for operating the marine vessel using the above-mentioned joystick device 100.

In the illustration provided, the vessel 300 is designed with a hull 302 having a bow 304, a stern 306. In the stern 306, four propulsion units 308, 310, 312 and 314 may be mounted. The propulsion units 308, 310, 312 and 314 may be pivotally arranged in relation to the hull 302 for generating a driving thrust in a desired direction of a generally conventional kind. The propulsion units may alternatively be inboard propulsion units, mounted under the vessel on the hull 302, or on the stern 306 as so called stern drives. That is, the propulsion units 308, 310, 312 and 314 may be outboard propulsion units or inboard propulsion units.

It should be understood that the vessel 300 may be provided with more than four (or less, including one) propulsion units. Furthermore, the vessel 300 may be provided with e.g. a bow thruster (not shown) for assisting in "moving" the bow 304, e.g. in windy situations. The 308, 310, 312 and 314, as well as the bow thruster, are operated based on the commands generated when tilting and/or rotating the movable steering member 102 in a manner as discussed above.

The processor may be or include any number of hardware components for conducting data or signal processing or for executing computer code stored in memory. The memory may be one or more devices for storing data and/or computer code for completing or facilitating the various methods described in the present description. The memory may include volatile memory or non-volatile memory. The memory may include database components, object code components, script components, or any other type of information structure for supporting the various activities of the present description. According to an exemplary embodiment, any distributed or local memory device may be utilized with the systems and methods of this description. According to an exemplary embodiment the memory is communicably connected to the processor (e.g., via a circuit or any other wired, wireless, or network connection) and includes computer code for executing one or more processes described herein.

The present disclosure contemplates methods, devices and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor.

By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data that cause a general-purpose computer, special purpose computer, or special purpose processing machines to perform a certain function or group of functions.

Although the figures may show a specific order of method steps, the order of the steps may differ from what is depicted. In addition, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps. Additionally, even though the disclosure has been described with reference to specific exemplifying embodiments thereof, many different alterations, modifications and the like will become apparent for those skilled in the art.

Variations to the disclosed embodiments can be understood and effected by the skilled addressee in practicing the claimed disclosure, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A joystick device operable to provide speed, direction and steering commands for controlling a marine vessel, the joystick device comprising a movable steering lever extending on an axis and adapted to be tilted from a neutral position in at least four directions including a forward, a rearward, a leftward, and a rightward direction, wherein:

an active length of the movable steering lever is adjustable between a first and a second lever length, the first lever length is shorter than the second lever length, the first lever length is used for operating the marine vessel in a first low speed docking mode, the second lever length is used for operating the marine vessel in a second high-speed drive mode wherein the low speed docking mode is lower than the high-speed drive mode, and the movable steering lever comprises a first and a second movable steering lever portion, wherein a first end of the first movable steering lever portion is arranged in relation to a base at a first controllable pivot point, and a second end of the first movable steering lever portion is connected to a first end of the second first movable steering lever portion at a second controllable pivot point, allowing the active length of the movable steering lever to be adjusted without adjusting an overall length of the movable steering lever, and further comprising a processing circuit adapted to:

receive an indication of a desire to transition between the first and the second mode, and control mechanical means for adjust the active length of the movable steering lever dependent on a state of the indication.

2. The joystick device according to claim 1, wherein the movable steering member is rotatable around the axis for providing rotational commands for controlling the marine vessel.

3. The joystick device according to claim 1, wherein the indication of a desire to transition between the first and the second mode is received from a user interface.

4. The joystick device according to claim 3, wherein the user interface comprises at least one button arranged with the joystick device.

5. The joystick device according to claim 1, wherein the indication of a desire to transition between the first and the second mode is formed based on at least one of a speed and a geographical location of the marine vessel.

6. The joystick device according to claim 1, further comprising feedback means adapted to create a haptic effect perceivable at the movable steering lever.

7. The joystick device according to claim 6, wherein the feedback means is operated dependent on a predetermined position of the movable steering member.

8. The joystick device according to claim 7, wherein the predetermined position is an end tilting position for the movable steering member.

9. The joystick device according to claim 7, wherein the predetermined position is at least one of an idle forward, an idle reverse position or the neutral position for the movable steering member.

10. The joystick device according to claim 1, wherein when in the first mode:

the first controllable pivot point is controlled to be fixed, and the second controllable pivot point is controlled to be movable.

11. The joystick device according to claim 1, wherein when in the second mode:

the first controllable pivot point is controlled to be movable, and the second controllable pivot point is controlled to be fixed.

12. The joystick device according to claim 1, wherein when in a third mode:

the first controllable pivot point is controlled to be movable, and the second controllable pivot point is controlled to be movable.

13. A marine propulsion control system controlling at least one propulsion units carried by a hull of a marine vessel, the marine propulsion control system comprising a joystick device operable to provide speed, direction and steering commands for controlling the marine vessel, the joystick device comprising a movable steering lever extending on an axis and adapted to be tilted from a neutral position in at least four directions including a forward, a rearward, a leftward, and a rightward direction, wherein:

an active length of the movable steering lever is adjustable between a first and a second lever length, the first lever length is shorter than the second lever length, the first lever length is used for operating the marine vessel in a first low speed docking mode, the second lever length is used for operating the marine vessel in a second high-speed drive mode wherein the low speed docking mode is lower than the high-speed drive mode, and the movable steering lever comprises a first and a second movable steering lever portion, wherein a first end of the first movable steering lever portion is arranged in relation to a base at a first controllable pivot point, and a second end of the first movable steering lever portion is connected to a first end of the second first movable steering lever portion at a second controllable pivot point, allowing the active length of the movable steering lever to be adjusted without adjusting an overall length of the movable steering lever, and an electronic processing circuit configured to:

receive an input command from the joystick device, and provide a set of control commands for controlling a desired delivered thrust, gear selection and steering angle for the at least one propulsion units.

14. A marine vessel, comprising:

at least one propulsion unit carried by a hull of the marine vessel, and a marine propulsion control system controlling the at least one propulsion unit, the marine propulsion control system comprising a joystick device operable to provide speed, direction and steering commands for controlling a marine vessel, the joystick device comprising a movable steering lever extending on an axis and adapted to be tilted from a neutral position in at least four directions including a forward, a rearward, a leftward, and a rightward direction, wherein:

an active length of the movable steering lever is adjustable between a first and a second lever length, the first lever length is shorter than the second lever length, the first lever length is used for operating the marine vessel in a first low speed docking mode, the second lever length is used for operating the marine vessel in a second high-speed drive mode wherein the low speed docking mode is lower than the high-speed drive mode, and the movable steering lever comprises a first and a second movable steering lever portion, wherein a first end of the first movable steering lever portion is arranged in relation to a base at a first controllable pivot point, and a second end of the first movable steering lever portion is connected to a first end of the second first movable steering lever portion at a second controllable pivot point, allowing the active length of the movable steering lever to be adjusted without adjusting an overall length of the movable steering lever, and an electronic processing circuit configured to:

receive an input command from the joystick device, and provide a set of control commands for controlling a desired delivered thrust, gear selection and steering angle for the at least one propulsion unit.

* * * * *